US007661809B2

(12) United States Patent
Taniuchi et al.

(10) Patent No.: US 7,661,809 B2
(45) Date of Patent: Feb. 16, 2010

(54) METHOD AND APPARATUS FOR FORMING IMAGE

(75) Inventors: Hiroshi Taniuchi, Kanagawa (JP); Akihiro Mouri, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 447 days.

(21) Appl. No.: 10/986,902

(22) Filed: Nov. 15, 2004

(65) Prior Publication Data

US 2005/0110855 A1 May 26, 2005

(30) Foreign Application Priority Data

Nov. 20, 2003 (JP) ..... 2003-391484

(51) Int. Cl.
*B41J 2/01* (2006.01)

(52) U.S. Cl. ..... 347/103; 347/101

(58) Field of Classification Search ..... 347/101, 347/102, 103

See application file for complete search history.

(56) References Cited

U.S. PATENT DOCUMENTS

| | | | | |
|---|---|---|---|---|
| 3,783,826 | A * | 1/1974 | Urbanek et al. | 118/620 |
| 5,099,256 | A * | 3/1992 | Anderson | 347/103 |
| 5,127,330 | A * | 7/1992 | Okazaki et al. | 101/450.1 |
| 5,132,706 | A * | 7/1992 | Yuasa et al. | 346/140.1 |
| 5,142,306 | A * | 8/1992 | Arahara et al. | 346/140.1 |
| 5,389,958 | A * | 2/1995 | Bui et al. | 347/103 |
| 5,841,456 | A * | 11/1998 | Takei et al. | 347/103 |
| 6,059,407 | A * | 5/2000 | Komatsu et al. | 347/103 |
| 6,086,197 | A * | 7/2000 | Kubota et al. | 347/96 |
| 6,095,639 | A * | 8/2000 | Uetsuki et al. | 347/65 |
| 6,196,674 | B1 * | 3/2001 | Takemoto | 347/103 |
| 6,257,716 | B1 * | 7/2001 | Yanagawa et al. | 347/102 |
| 6,318,853 | B1 * | 11/2001 | Asano et al. | 347/103 |
| 6,354,700 | B1 * | 3/2002 | Roth | 347/103 |
| 6,385,405 | B1 * | 5/2002 | Kingsland | 399/2 |
| 6,386,683 | B1 * | 5/2002 | Muroi et al. | 347/55 |
| 6,460,973 | B1 * | 10/2002 | Takahashi et al. | 347/55 |

(Continued)

FOREIGN PATENT DOCUMENTS

JP 61-44688 3/1986

(Continued)

OTHER PUBLICATIONS

Official Notice of Rejection for Japanese Patent Application No. 2003-391484, mailed May 29, 2007, with English-language translation.

*Primary Examiner*—Stephen D Meier
*Assistant Examiner*—Leonard S Liang
(74) *Attorney, Agent, or Firm*—Fitzpatrick, Cella, Harper & Scinto

(57) ABSTRACT

A method and apparatus for forming an image which can form a high-quality image on a great variety of print media regardless of the surface roughness or ink absorptivity of the print medium, without sacrificing the high degree of freedom of the ink jet printing system are provided. An ink jet printing section ejects ink to an intermediate transfer body to form an ink image on the intermediate transfer body. Before the ink image thus obtained is transferred to a print medium, an ink transfer adjuvant is applied to the print medium. Then, the ink image formed on the intermediate transfer body is transferred to the print medium to which the ink transfer adjuvant has been applied.

11 Claims, 2 Drawing Sheets

U.S. PATENT DOCUMENTS

| | | | | |
|---|---|---|---|---|
| 6,540,344 | B2 | 4/2003 | Kashiwazaki et al. | 347/100 |
| 6,648,468 | B2 * | 11/2003 | Shinkoda et al. | 347/103 |
| 6,682,189 | B2 * | 1/2004 | May et al. | 347/103 |
| 6,716,562 | B2 * | 4/2004 | Uehara et al. | 430/124 |
| 6,719,423 | B2 * | 4/2004 | Chowdry et al. | 347/103 |
| 6,857,735 | B2 * | 2/2005 | Furukawa | 347/103 |
| 6,860,593 | B2 | 3/2005 | Kashiwazaki et al. | 347/100 |
| 7,281,790 | B2 * | 10/2007 | Mouri et al. | 347/103 |
| 2004/0182270 | A1 | 9/2004 | Wiedemer et al. | 101/465 |

FOREIGN PATENT DOCUMENTS

| | | |
|---|---|---|
| JP | 5-200999 | 8/1993 |
| JP | 5-74844 | 10/1993 |
| JP | 6-199032 | 7/1994 |
| JP | 7-133451 | 5/1995 |
| JP | 7-256873 | 10/1995 |
| JP | 2000-318300 | 11/2000 |

* cited by examiner

METHOD AND APPARATUS FOR FORMING IMAGE

BACKGROUND OF THE INVENTION

1. Field of the Invention

The present invention relates to a method and an apparatus for forming an image, and more specifically, to a method and an apparatus for forming an image in which an intermediate transfer body is used to form an image on a print medium in order to avoid adverse effects due to the amount of ink absorbed by the print medium.

2. Description of the Related Art

At present, as a method of forming an image using an ink jet printing system, output devices of personal computers and the like are known. Such devices mainly employ a direct printing system that forms an image by ejecting ink directly on a recording medium. The direct printing system has a simple apparatus configuration. Further, relatively inexpensive relevant products are commercially available on the market. Accordingly, this system is suitable for use as a simple printer. On the other hand, disadvantageously, output image quality depends on print media (mainly paper) and exclusive print media must be used to output an image from a digital camera so that the image has a high quality. Exclusive paper for high image quality outputs is expensive, and there are only a few types of such paper. In particular, no exclusive paper is available such as thin glossy print paper suitably used for offset printing. This is partly why the ink jet printing system is not used for commercial printing.

However, the use of the ink jet printing system enables the quality of an outputted image to be improved and facilitates coloring. Moreover, inks for ink jet printing are relatively inexpensive and there are a great variety of such inks. It has thus been desirable to allow a high-quality image to also be formed on print media other than ink jet print media, using the ink jet printing system, which has the above advantages.

The quality of output images based on the ink jet printing system depends on print media because ink jet inks are fixed by absorption of the ink into the print media. Almost all the components of the ink jet ink are liquid. Accordingly, if only a little or no ink jet ink is absorbed into the print media, an enormously long time is required for drying. If the ink jet ink contains a nonvolatile liquid, it may not appropriately dry. Moreover, inappropriate printing may occur; adjacent printed ink droplets may be mixed together (bleeding) or an ink droplet having already impacted a print medium may be drawn to an ink droplet impacting the print medium later (beading). Thus, at present, it is very difficult to form images on print media into which little or no ink jet ink is absorbed, using the ink jet printing system.

In contrast, if an image is printed on a print medium with an excessively high ink permeability, a coloring material strike-through may occur resulting in insufficient coloring or the surface of the print medium may become wavy. Likewise, if a thin print medium is used, ink strike-through caused by penetration of inks or a wavy surface such as cockling may occur. In this manner, printing by the ink jet printing system tends to be significantly limited by the amount of ink absorbed into the print medium.

Further, almost all the components of the ink jet ink are moist because the ink jet printing system enables inks of only low viscosity to be ejected. The ink jet printing system includes a continuous system, a bubble jet (registered trademark) system that is an on-demand system, and a piezo system. Any of these systems enable inks of only low viscosity to be ejected. This is because inks used for the ink jet printing system must have a high fluidity in an ink jet head in order to meet ejection appropriateness. In contrast, the inks must have a low fluidity on the print medium so as to prevent adjacent ink droplets from being mixed together on the print medium or prevent ink droplets from drawing each other as described above. In this manner, with the ink jet printing system, even though the inks with a high fluidity are ejected to the print medium, they must have a low fluidity on the print medium. Accordingly, inconsistent characteristics are required.

To meet these inconsistent demands on the inks, a printing method (also referred to herein as a "transfer ink jet printing method) has been proposed which comprises forming an ink image on a transfer body (also referred to as an intermediate transfer body) and transferring the ink image formed on the transfer body to a desired print medium to form the ink image on the desired print medium. With this system, inks ejected from the ink jet head are allowed to adhere to the intermediate transfer body. An ink image is thus formed which has a fluidity reduced to some degree. Subsequently, the ink image is transferred from the intermediate transfer body to the print medium.

With the transfer ink jet printing method, the rate of ink transferred from the intermediate transfer body to a print medium (also referred to herein as a "transfer rate") is an important element. To transfer an ink image of a sufficient density to the print medium at a low transfer rate, it is necessary to increase the amount of ink ejected to the intermediate transfer body. However, an increase in the amount of ink applied increases the incidence of bleeding or beading, described above. Moreover, in terms of productivity, it is not preferable to increase the amount of moisture removed or a load on cleaning of the transfer body, besides the amount of ink applied.

Various methods have been proposed in order to improve the transfer rate. For example, Japanese Patent Application Laid-open Nos. 6-199032 (1994) and 7-133451 (1995) propose a method of providing a release layer on the transfer body which is used to release inks from the intermediate transfer body during transfer, in order to improve the transfer rate. However, if a liquid layer that is the release layer is provided on the transfer body, an ink image formed on this layer is not fixed. Consequently, the ink image may be "distorted," or "bleeding" or "misalignment" may be caused by a transfer pressure exerted during transfer. That is, an image grade may be degraded. Moreover, the presence of the liquid layer requires the ink image to be dried so as not to dry the liquid layer. This hinders the drying of the ink image, thus affecting an increase in speed and the robustness of the image.

Further, Japanese Patent Application Laid-open No. 5-200999 (1993) discloses an apparatus that transfers an image to a print medium by allowing an ink jet print head to inject ink droplets into an intermediate transfer body, into which a solvent in the ink is absorbed to concentrate the ink. However, defects may occur in this apparatus; a long time may be required to absorb the solvent, or absorption holes formed in the intermediate transfer body to absorb the solvent may be clogged up. Moreover, the absorbed ink solvent may remain on the intermediate transfer body to make the image nonuniform between its parts with the ink solvent and its parts without the ink solvent. Further, it is necessary to provide means for removing the absorbed ink solvent. Accordingly, a large amount of energy is consumed in recovering the transfer body to its initial state, including the absorption of the solvent.

Thus, regardless of whether the method (direct printing) of forming an image by allowing the ink jet head to eject inks directly to a print medium or the transfer ink jet printing method is used, there remain problems to be solved in terms of the degree of freedom for available print media.

As is apparent from the above description, for printing with the ink jet printing method, a system using an intermediate transfer body is effective in increasing the degree of freedom for print media. However, even for the system using the intermediate transfer body, there remain problems to be solved in order to transfer high-quality ink images to the print medium. In particular, to form a high-quality image on a great variety of print media including those having a rough surface or a low ink absorptivity, it is necessary to transfer the inks on the intermediate transfer body to those print media at a high transfer rate.

The transfer rate is affected by the surface roughness or ink absorptivity of the print medium and thus greatly varies with the types of print media. For example, if the surface roughness of the print medium is larger than the thickness of ink formed on the intermediate transfer body, a convex portion and a concave portion of the print medium have different ink contact areas. Further, the higher the concavity of the concave portion, the smaller its contact area. In other words, the transfer rate decreases with increasing roughness of the surface of the print medium. Further, transfer conditions such as the transfer pressure must be varied depending on the ink absorptivity. Accordingly, a high transfer rate cannot be achieved unless the transfer is carried out under optimum transfer conditions. However, it is difficult to control the transfer conditions in accordance with the ink absorptivity. Therefore, it is difficult to achieve a high transfer rate when taking the ink absorptivity into account.

SUMMARY OF THE INVENTION

It is an object of the present invention to provide a method and an apparatus for forming an image which can form a high-quality image on a great variety of print media regardless of the surface roughness or ink absorptivity of the print medium, without sacrificing the high degree of freedom of the ink jet printing system.

In the first aspect of the present invention, there is provided an image forming method comprising the steps of:

forming an image of inks by ejecting ink to an intermediate transfer body;

applying a first material to a print medium, the first material increasing the rate of ink transferred from the intermediate transfer body to the print medium; and transferring the image of ink formed on the intermediate transfer body to the print medium to which the first material has been applied.

In the second aspect of the present invention, there is provided an image forming method of forming an image on a print medium by transferring an image of ink formed on an intermediate transfer body to the print medium, the method comprising the steps of:

applying a first liquid to the intermediate transfer body, the first liquid including a component that makes color materials of the ink coagulate;

applying the ink to the intermediate transfer body to which the first liquid has been applied;

applying a second liquid including a resin to the print medium; and.

transferring the image of ink formed on the intermediate transfer body to the print medium to which the second liquid has been applied.

In the third aspect of the present invention, there is provided an image forming method of forming an image on a print medium by transferring an image of ink formed on an intermediate transfer body to the print medium, the method comprising the steps of:

applying a first liquid to the intermediate transfer body, the first liquid including a component that makes color materials of the inks coagulate;

applying the ink to the intermediate transfer body to which the first liquid has been applied;

applying a second liquid improving surface energy of the print medium to the print medium; and transferring the image of ink formed on the intermediate transfer body to the print medium to which the second liquid has been applied.

In the fourth aspect of the present invention, there is provided an image forming method of forming an image on a print medium by transferring an image of ink formed on an intermediate transfer body to the print medium, the method comprising the steps of:

executing a plasma treatment on the intermediate transfer body;

applying a liquid including a surface active agent to the intermediate transfer body executed with the plasma treatment;

applying a liquid including polyvalent metal ions to the intermediate transfer body to which the liquid including the surface active agent has been applied;

applying ink including pigments to the intermediate transfer body to which the liquid including polyvalent metal ions has been applied;

applying a liquid including a resin to the print medium; and transferring the image of ink formed on the intermediate transfer body to the print medium to which the liquid including the resin has been applied.

In the fifth aspect of the present invention, there is provided an image forming apparatus comprising:

an intermediate transfer body having a surface layer receiving ink;

an image forming means for forming an image of ink by ejecting the ink on the intermediate transfer body;

an applying means for applying a first material to a print medium, the first material increasing the rate of ink transferred from the intermediate transfer body to the print medium; and a transfer means for transferring the image of ink formed on the intermediate transfer body to the print medium to which the first material has been applied.

The term "print media" as used herein refers not only to paper used in common printing apparatuses but also widely to cloths, plastic films, and other materials that can receive inks.

Further, the term "first material" as used herein may be an ink transfer adjuvant.

According to an embodiment of the present invention, inks are ejected to the intermediate transfer body to form an ink image. Then, the ink image is transferred to the print medium to which the ink transfer adjuvant has already been applied. This increases the surface energy of the print medium and improves its surface smoothness to provide different print media with uniform surface properties. It is thus possible to increase the transfer rate. Therefore, a high-quality image can be formed on a variety of print media.

The above and other objects, effects, features and advantages of the present invention will become more apparent from the following description of embodiments thereof taken in conjunction with the accompanying drawings.

DETAILED DESCRIPTION OF PREFERRED EMBODIMENTS

An embodiment of the present invention will be described below with reference to the drawings.

Figure 1:
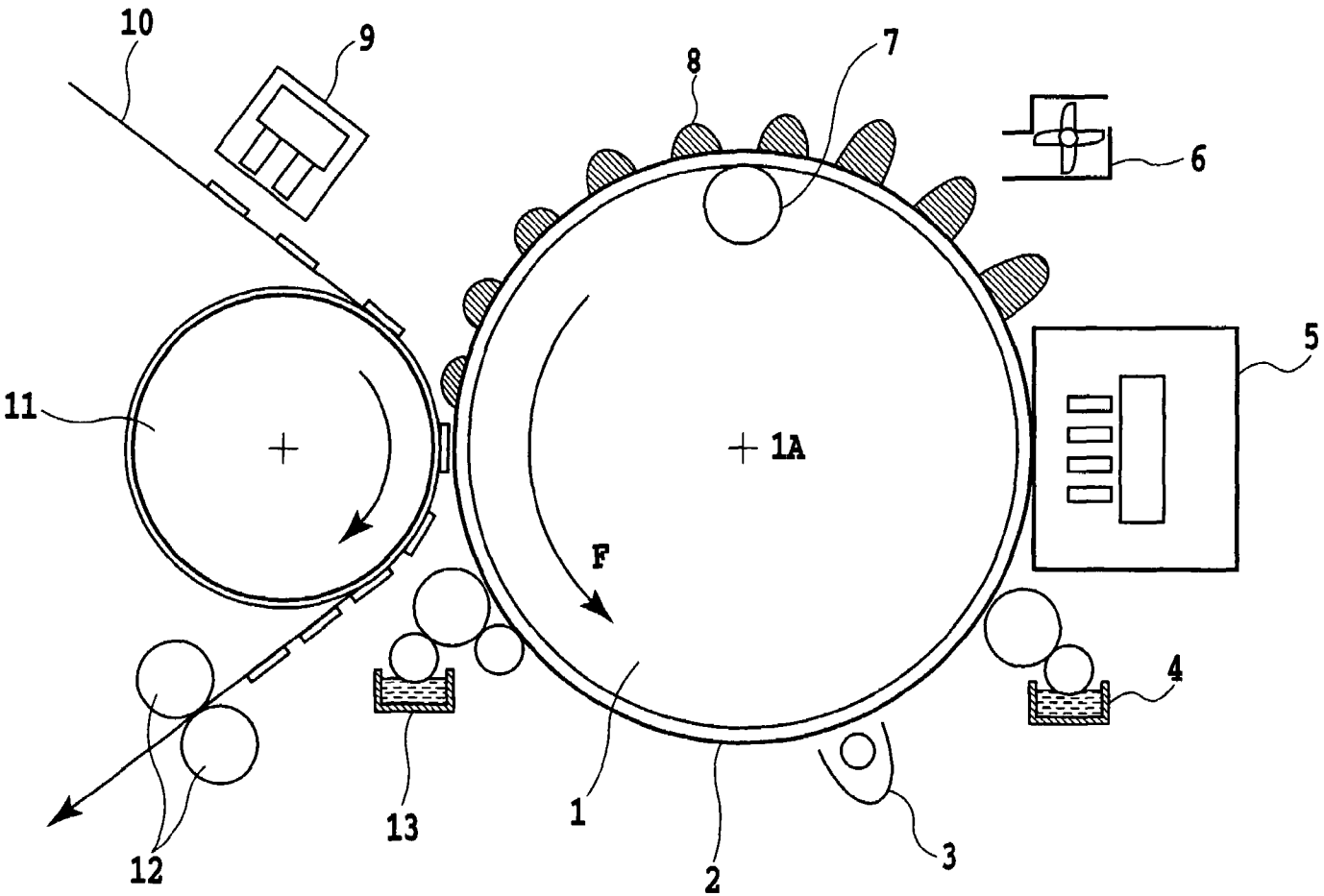
FIG. 1 is a schematic diagram showing an image forming apparatus according to an embodiment of the present invention.

FIG. 1 is a schematic diagram showing an image forming apparatus according to an embodiment of the present invention.

In FIG. 1, reference numeral 1 denotes an intermediate transfer body rotatively driven around an axis 1A in the direction of an arrow F. The intermediate transfer body 1 has a surface layer 2 on its surface. Reference numeral 3 in FIG. 1 denotes a hydrophilicity treating device. The intermediate transfer body 1 rotates in the direction of the arrow F to allow the hydrophilicity treating device 3 to modify the surface of the surface layer 2. Subsequently, a coating device 4 placed in contact with the surface of the intermediate transfer body 1 coats an image fixing component (e.g. a reacting liquid reacting with inks) on the intermediate transfer body 1. Moreover, after the image fixing component has been coated, an ink jet printing section 5 ejects ink droplets to the intermediate transfer body 1 to form ink dots. An ink image (mirror image) is thus formed on the surface of the intermediate transfer body 1. On the other hand, a transfer adjuvant applying device 9 applies an ink transfer adjuvant to a print medium. Then, a print surface of the print medium 10 applied with the ink transfer adjuvant is brought into contact with the ink image formed on the intermediate transfer body 1. At this time, a pressurizing roller 11 pressurizes the print medium 10 to transfer and forms an image to and on the print medium 10.

In the apparatus illustrated in FIG. 1, a moisture removal facilitating device 6 is provided in order to evaporate and remove moisture or solvent components from inks constituting the image on the intermediate transfer body 1. Additionally or alternately, a heating roller 7 may be used which contacts with a rear surface of the hollow intermediate transfer body 1 to heat it.

A fixing roller 12 is used to pressurize the print medium 10 on which the image has been formed via the intermediate transfer body as described above. This serves to smooth the surface of the print medium 10. Further, the fixing roller 12 heats the print matter to immediately make it robust.

In FIG. 1, a cleaning unit 13 cleans the intermediate transfer body from which the ink image has been transferred to the print medium, to provide for the next image formation.

In conventional ink jet printing apparatuses, the inks are fixed by permeation through the print medium. The image grade thus varies depending on the amount of ink absorbed by the print medium. Consequently, available print media are limited. On the other hand, offset printing apparatuses are intended to provide a large amount of the same print matter. These printing apparatuses thus lack the flexibility of printing such as a function to perform a different image output for every sheet.

In contrast, as is apparent from the embodiment of the above image forming apparatus, the present invention enables high-grade images to be formed on various media. As a result, images can be formed by effectively utilizing the advantages of the ink jet printing system, which enables flexible printing, that is, enables desired print matter to be immediately obtained.

Figure 2:
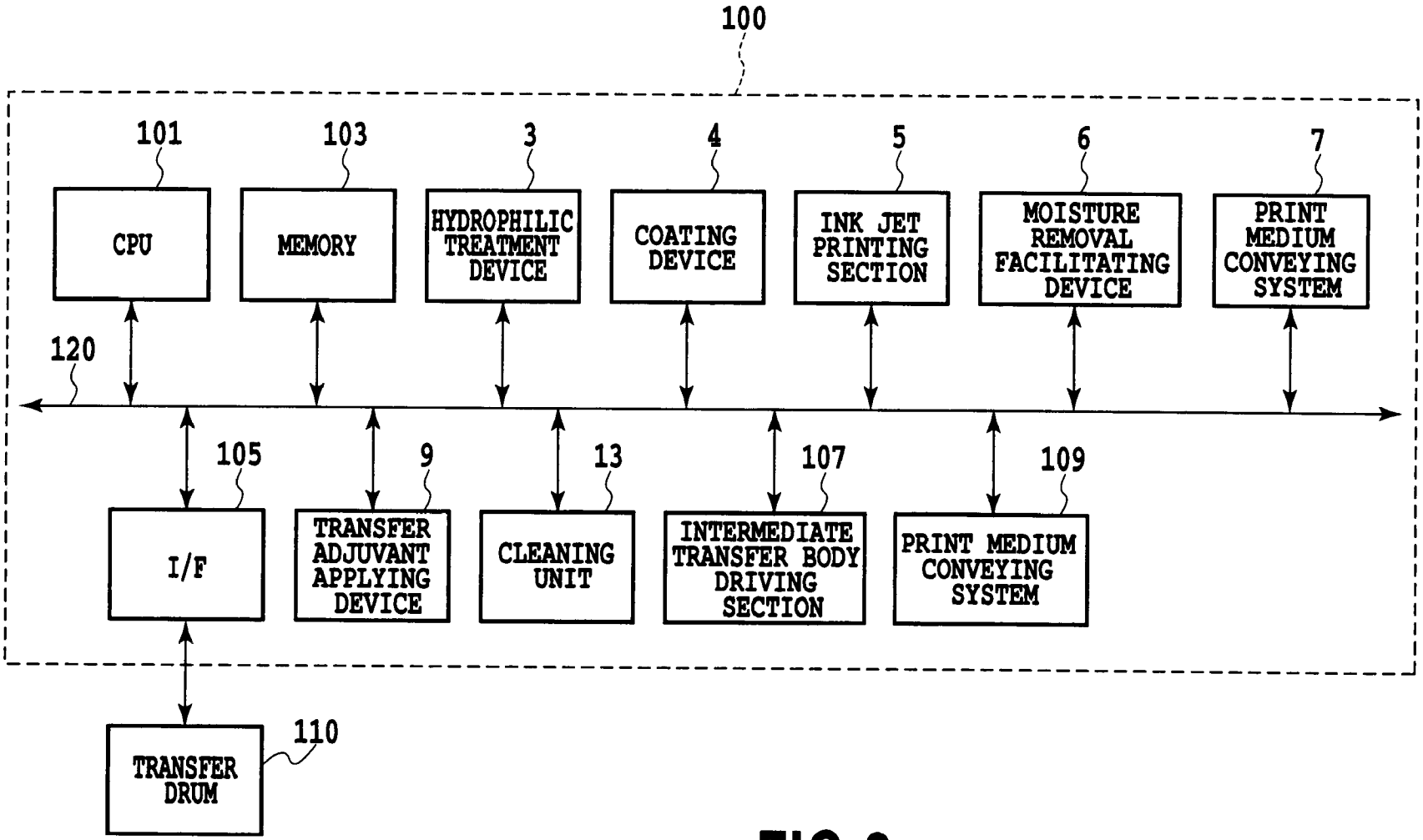
FIG. 2 is a schematic block diagram of a control system in an image forming apparatus to which the present invention is applicable.

FIG. 2 is a schematic block diagram of a control system in an image forming apparatus to which the present invention is applicable.

In an image forming apparatus generally shown by reference numeral 100, reference numeral 101 denotes a CPU serving as a main control section of the whole system to control each section. Reference numeral 103 denotes a memory composed of for example, a ROM in which basic programs for the CPU 101 are stored and a RAM used to temporarily save various data or process image data or used as a work area. Reference numeral 105 denotes an interface which is a source of image data in the form of a host computer or the like and which transmits and receives data and commands to and from an image supplying device 110.

Reference numeral 107 denotes a driving section that rotatively drives the intermediate transfer body 1 during steps (a) to (c) described later. Reference numeral 109 denotes a conveying system for the print medium 10 including for example, a section driving the pressurizing roller 11 and fixing roller 12. Reference numeral 120 denotes a bus line connected not only to the above sections but also to the hydrophilicity treating device 3, the coating device 4, the ink jet printing section 5, the moisture removal facilitating device 6, the heating roller 7, the transfer adjuvant applying device 9, and the cleaning unit 13. The bus line 120 transmits control signals from the CPU 101.

Further, each of the sections to be controlled is provided with a status detecting sensor. A detection signal from the status detecting sensor can be communicated to the CPU 101 via the bus line 120.

If image data sent by the image supplying device 110 is not mirrored, the above control system executes an inverting process to create mirror image data.

The above image forming apparatus includes means for executing a step of using the ink jet printing section to form an image on the intermediate transfer body (hereinafter referred to as a step (a)), a step of applying the ink transfer adjuvant to at least part of the print medium (hereinafter referred to as a step (b)), a step of transferring the image formed on the intermediate transfer body to the print medium (hereinafter referred to as a step (c)). The steps (a) to (c) and the executing means will be described below in detail.

1. Step (a)

The step (a) uses the ink jet printing section to form an image on the intermediate transfer body.

In FIG. 1, the intermediate transfer body 1 employs a drum made of a light weight metal such as an aluminum alloy as a support for the surface layer of the intermediate transfer body in connection with rigidity required to withstand the pressurization during transfer and dimensional accuracy as well as requested characteristics such as a reduction in rotational inertia for improving responses to control. Moreover, the releasable surface layer 2 is provided on the sides of the drum.

Further, the intermediate transfer body according to the present invention may have any shape provided that its surface layer is at least in line contact with the print medium. Specifically, a drum-, roller-, belt-, or sheet-like intermediate transfer body may be used in accordance with the form of the applied image forming apparatus or the form of transfer to the print medium. The material for the intermediate transfer body is not particularly limited and may be metal, glass, plastic, rubber, or the like. Further, the surface layer 2 may not be provided on the intermediate transfer body 1 or may be composed of a plurality of layers. Further, even if the surface layer and the print medium are not in line contact with each other, a material such as a printing pad which is significantly elastically deformed can be used as the intermediate transfer body in accordance with the shape of the print medium.

In FIG. 1, the surface layer 2 is releasable. However, the surface layer 2 of the intermediate transfer body is not particularly limited. However, the surface layer 2 is desirably made of a releasable material in order to improve the transfer rate. The surface layer 2 is also desirably made of a non-permeable (non-absorbing) material. In particular, if a transfer adjuvant mentioned later is applied to an area which is larger an ink image, it is favorable for preventing adhesion at the time of contact with the print medium. Here, the releasability refers to the characteristic that an ink, an image fixing component, a wettability improving component and an ink image which is a mixture of these materials is unlikely to stick to the surface and can be released later. An increased releasability is more advantageous in the load on cleaning and the ink transfer rate. In contrast, an increased releasability reduces the critical surface tension of the material to make the material repellent; liquids such as ink are unlikely to stick to the material. Consequently, it becomes difficult to hold the image. The releasable surface described in the present invention refers to a surface having a critical surface tension of at most 30 mN/m or a water contact angle of at least 75° at a physical property before a surface treatment (hydrophilic treatment) mentioned later. In other words, in the present invention, the surface of the intermediate transfer body is preferably made of a material that repels inks impacting the surface to prevent the formation of an image before the surface is treated (that is, the material insufficiently holds an ink image).

Specifically, a method of obtaining a releasable surface layer includes, for example, executing a surface treatment such as Teflon (registered mark) treatment or application of silicone oil to form a surface layer on the intermediate transfer body, or using a releasable material as a surface layer.

Further, the surface layer 2 is preferably made of an elastomer so as to accommodate various print media. Preferably, the elastomer may be surface treated NBR or urethane rubber, or fluorine rubber or silicone rubber, which tends to repel inks. Any of various types of silicone rubber, including a vulcanized type, one-compound cured type, and two-compound curing type, may be suitably used. The rubber hardness of the surface layer 2, provided on the intermediate transfer body 1 and consisting of an elastomer, is affected by the thickness or hardness of the print medium 10, brought into contact with the surface layer 2. Accordingly, the rubber hardness is desirably optimized in each case, but a rubber hardness of 10 to 100° is effective and a rubber hardness of 40 to 80° enables almost all print sheets to be accommodated.

In the step (a), the ink jet printing section 5 is used to apply inks to the intermediate transfer body 1, configured as described above, to form an image.

The embodiment shown in FIG. 1 employs aqueous inks. However, since the surface layer 2 of the intermediate transfer body is releasable, the ink applied to the intermediate transfer body may run and cause beading or bleeding if no special measures are taken. Thus, before the ink jet printing section 5 applies the ink, the applying section 4 applies the image fixing component (reacting liquid) to the intermediate transfer body, in order to suppress the fluidity of the ink on the intermediate transfer body. This allows the ink to contact with the image fixing component on the intermediate transfer body. This reduces the fluidity of the ink on the intermediate transfer body. Thus, the ink can be held at the position which it has impacted.

Here, an increase in the viscosity of the ink means not only that a contact of the image fixing component with the ink causes a color material, resin, or the like, a part of the composition of the ink, to chemically react with or physically adsorb the image fixing component to cause a noticeable increase in the viscosity of the whole ink but also that the solids in the composition of the ink are condensed to cause a local increase in viscosity.

Here, the fixation of the image means not only that (1) the viscosity of the ink is increased or (2) a contact of the image fixing component with the ink causes a color material, resin, or the like, a part of the composition of the ink, to chemically react with or physically adsorb the image fixing component to cause a noticeable reduction in the fluidity of the whole ink but also that the solids in the composition of the ink are condensed to cause a local increase in viscosity.

In this manner, the image fixing component is applied before the ink is applied. However, even if the image fixing components are applied directly to the releasable surface layer 2, the components may not be uniformly applied. Accordingly, before the application of the image fixing component, the hydrophicility treating apparatus 3 preferably executes a hydrophilicity treatment for improving the wettability (surface energy) of the surface layer 2 of the intermediate transfer body, in order to uniformly apply the image fixing component.

According to the present embodiment, in the step (a), the hydrophilicity treating device 3 is applied to modify the surface of the intermediate transfer body 1, having the releasable surface layer 2. As described above, the releasable material generally has a low critical surface tension and thus repels the inks and liquids such as the image fixing component, described later. Thus, the hydrophilicity treating device 3 modifies the surface to suppress the repellence of the inks and the image fixing component, in order to uniformly apply or coat the inks and the image fixing component to the intermediate transfer body 1.

The hydrophilicity treating means is suitably a method of applying a wettability improving component (e.g. a liquid containing a surface active agent) to the surface of the intermediate transfer body 1 or a method of irradiating the surface of the intermediate transfer body 1 with energy to modify the surface. These methods can be used together.

Any surface active agent can be used including, for example, a common cationic surface active agent, a common anionic surface active agent, a common nonionic surface active agent, a common ampholytic surface active agent, a common fluorine-containing surface active agent, or a common silicone-containing surface active agent. Among them, the fluorine-containing surface active agent or the silicone-containing surface active agent may be suitably used because the releasable surface of the intermediate transfer body, cited as a suitable example according to the present invention, is composed of low surface energy. Further, means for applying the surface active agent is not limited. However, since the surface active agent works sufficiently in thin film form, a roll coater is suitably used.

Further, any energy applying means, including irradiation with ultraviolet rays, a frame treatment, a corona discharge treatment, and a plasma treatment, may be used without limitation provided that the means can execute a treating process. Among them, a plasma treatment under the atmospheric pressure or a reduced pressure is a suitable treating method. It is particularly suitable to use a material containing the fluorine compound or a silicone compound, for the releasable surface layer. This combination is effective not only on the hydrophilicity treating process but also in preventing a decrease in or improving the transfer rate at which the ink image formed on the intermediate transfer body is transferred to the print medium during the subsequent step. The plasma process as used herein includes a part of a corona discharge process of activating oxygen in the atmosphere to generate a hydrogen group on the surface of a treatment base material. Further, the fluorine compound and silicone compound as used herein contain respective oil components.

A mechanism has not been completely clarified which produces suitable effects using the materials and surface treating means selected as described above. However, there are clear tendencies; in the presence of a fluorine- or silicone-containing oil component, the surface becomes hydrophilic, the transfer rate is maintained or improved, and these two effects are significant and consistent with each other. Moreover, one process lastingly produces these effects. Thus, the following estimation can be made. A chemical action (introduction of a surface hydrophilic group) generally said to result from the plasma process partly makes the rubber component, filler component, and oil component hydrophilic. Further, a physical action (surface roughening) partly destroys the rubber structure to promote the surface movement of the oil component.

The process may comprise using a surface modified material as the surface layer of the intermediate transfer body, having energy applying means in the apparatus to execute surface modification at fixed intervals, or executing both of these processes.

If both surface active agent and energy are applied as hydrophilicity treating means, it is effective to apply energy before the surface active agent.

On the other hand, in FIG. 1, the coating device 4 coats the image fixing component on the surface of the intermediate transfer body 1 subjected to the hydrophicility treating process as described above.

The image fixing component according to the present invention reacts quickly to inks provided by the ink jet printing section 5 to reduce the fluidity of the inks. In particular, a material which makes the color materials of the inks coagulate is desirable as the image fixing component.

Such an image fixing component must be appropriately selected in accordance with the types of the inks used for image formation. For example, a polymer flocculant is effectively used for dye inks, whereas metal ions are effectively used for pigment (consisting of dispersed fine particles) inks. Moreover, if the dye inks are combined with the metal ions as the image fixing component, each ink may be mixed with a pigment having a color similar to that of the corresponding dye. Alternatively, it is possible to mix white or transparent fine particles, which insignificantly affects hues, or add a water-soluble resin reacting with the metal ions.

The polymer flocculant used as the image fixing component includes, for example, a cationic polymer flocculant, an anionic polymer flocculant, a nonionic polymer flocculant, or an ampholytic polymer flocculant.

Further, the metal ions include, for example, bivalent metal ions such as $Ca^{2+}$, $Cu^{2+}$, $Ni^{2+}$, $Mg^{2+}$, and $Zn^{2+}$ and trivalent metal ions such as $Fe^{3+}$ and $Al^{3+}$. If these ions are applied, they are desirably in the form of a water solution of metal salt. Cations of metal salt include $Cl^-$, $NO_3^-$, $SO_4^-$, $I^-$, $Br^-$, $ClO_3^-$, and RCOO (R is an alkyl group).

A smaller amount of image fixing component is preferably applied in order to prevent the running of the ink image while facilitating drying. However, in terms of reactivity, the total number of charges in the metal ions is desirably twice or more as large as that in negative-polarity ions in the coloring inks. To accomplish this, it is possible to use an about 10 wt % water solution of the metal salt listed above. The applied layer works sufficiently in the form of a thin film.

As means for applying the image fixing component, FIG. 1 illustrates the coating device 4 in the form of a roll coater. However, the present invention is not limited to this aspect. For example, it is possible to use a print head ejecting a liquid of the image fixing component using a spray coater or an ink jet system. In particular, the ink jet system allows the application of the ink fixing component in a pattern based on a printing image.

A water-soluble resin or a water-soluble crosslinking agent can also be added in order to improve the robustness of the image finally formed. The material used is not limited provided that it can coexist with the image fixing component. The water-soluble resin is suitably PVA or PVP particularly if a highly reactive metal salt is used as the image fixing component. The water-soluble crosslinking agent is suitably oxazolin or carbodiimide, which reacts with carboxylic acid, which is suitably used in the ink to disperse the color material.

Alidin is a material that can make the increased viscosity of the ink and the robustness of the image relatively consistent with each other.

In FIG. 1, the hydrophilicity treating device 3 executes a hydrophilicity treatment on the surface of the intermediate transfer body 1 before the image fixing component is applied. On the other hand, the above surface active agent is effectively added to the image fixing component in order to uniformly apply the image fixing component.

In the embodiment shown in FIG. 1, the ink jet printing section 5 applies the inks to the intermediate transfer body treated as described above, to form an ink image.

In FIG. 1, the ink ejecting system and form of the ink jet printing section 5 are not particularly limited. The inks may be ejected by an on-demand system using electrothermal converting elements (heating elements) or electromechanical converting elements (piezo elements), instead of the continuous system. Further, for example, in connection with the configuration shown in FIG. 1, the ink jet printing section may use an ink jet head in line head form having ink ejection openings arranged in an axial direction of the intermediate transfer body 1 (the direction orthogonal to the sheet of the drawing). Further, the print head may have nozzles arranged within a predetermined range in a circumferential or axial direction (the direction perpendicular to the sheet of FIG. 1) of the intermediate transfer body 1. An image may be sequentially formed on the transfer drum 1 while scanning the print head in the axial direction. Moreover, the number of heads may be varied depending on the colors of the inks used for image formation.

The inks used in the step (a) are not particularly limited but aqueous inks, which insignificantly affect environments, can also be suitably used. The aqueous ink has a common dye or pigment as color material and an aqueous liquid medium for dissolving and dispersing the dye or pigment. In particular, the pigment ink is suitably used because it provides robust print images.

Available dyes include, for example, C. I direct blue 6, 8, 22, 34, 70, 71, 76, 78, 86, 142, and 199, C. I acid blue 9, 22, 40, 59, 93, 102, 104, 117, 120, 167, and 229, C. I direct red 1, 4, 17, 28, 83, and 227, C. I acid red 1, 4, 8, 13, 14, 15, 18, 21, 26, 35, 37, 249, 257, and 289, C. I direct yellow 12, 24, 26, 86, 98, 132, and 142, C. I acid yellow 1, 3, 4, 7, 11, 12, 13, 14, 19, 23, 25, 34, 44, and 72, C. I food black 1 and 2, and C. I acid black 2, 7, 24, 26, 31, 52, 112, and 118.

Available pigments include, for example, C. I pigment blue 1, 2, 3, 15:3, 16, and 22, C. I pigment red 5, 7, 12, 48(Ca), 48(Mn), 57(Ca), 112, and 122, C. I pigment yellow 1, 2, 3, 13, 16, and 83, carbon black No 2300, 900, 33, 40, 52, MA7, 8, and MCF88 (manufactured by MITSUBISHI CHEMICAL CORPORATION), RAVEN1255 (manufactured by Columbia), REGAL33OR, 660R, MOGUL (manufactured by Cabbot), and Color Black FW1, FW18, S170, S150, and Printex35 (manufactured by Degussa).

The form of these pigments is not limited but any of for example, a self-dispersion type, a resin dispersion type, and a micro capsule type may be used. A dispersant for the pigments is suitably a dispersing resin which is soluble to water and which has a weighted mean molecular weight of about 1,000 to 15,000. Specifically, available dispersants include, for example, a block copolymer or random copolymer consisting of a vinyl-containing water soluble resin, styrene and its derivative, vinyl naphthalene and its derivative, an aliphatic alcohol ester of α, β-ethylene unsaturated carboxylic acid, acrylic acid and its derivative, maleic acid and its derivative, itaconic acid and its derivative, fumaric acid and its derivative, or their salts.

A water-soluble resin or a water-soluble crosslinking agent can also be added in order to improve the robustness of the image finally formed. The material used is not limited provided that it can coexist with the image fixing component. The water-soluble resin is suitably used by adding the above dispersant or the like to this resin. As the water-soluble crosslinking agent, oxazolin or carbodiimide, which reacts slowly, is suitably used in terms of ink stability.

An organic solvent may be contained in the aqueous liquid medium constituting the ink together with the above color material. The amount of organic solvent is a factor that determines the physical properties of the ink having its viscosity increased by a treatment described later. With the system using the intermediate transfer body according to the present invention, the ink is substantially composed of the color material and a high-boiling-point organic solvent when transferred to the print medium. The ink is designed so that the color material and the organic solvent have their optimum values. The organic solvent used is preferably a water-soluble material such as those listed below which has a high boiling point and a low vapor pressure.

Available organic solvents include, for example, polyethylene glycol, polypropylene glycol, ethylene glycol, propylene glycol, butyrene glycol, triethylene glycol, thiodiglycol, hexylene glycol, diethylene glycol, ethylene glycol monomethyl ether, diethylene glycol monomethyl ether, and glycerin. Two or more may be selected from these solvents and mixed together. Further, as a component that adjusts the viscosity, surface tension, and the like of the ink, alcohol such as ethyl alcohol or isopropyl alcohol or a surface active agent may be added to the ink.

The blend ratio of the components constituting the ink is also not limited. The blend ratio can be appropriately adjusted on the basis of the selected ink jet printing system, the ejection force of the head, the diameter of the nozzles, and the like as long as the ink can be ejected. In general, the ink can be composed of 0.1 to 10 wt % of dye, 5 to 40 wt % of solvent, and 0.01 to 5 wt % of surface active agent. The remaining part of the ink can be adjusted using pure water.

2. Step (b)

The step (b) applies the ink transfer adjuvant to at least a part of the print medium.

The ink transfer adjuvant according to the present invention is a material that allows the inks on the intermediate transfer body to be transferred to the print medium at a high transfer rate. That is, the ink transfer adjuvant allows the inks to be transferred, at a high transfer rate, to a great variety of print media including those having a rough (irregular) surface or a low ink absorptivity. By applying the ink transfer adjuvant to the print medium or coating the print medium with the ink transfer adjuvant before a transfer step described later, it is possible to accomplish transfer at a high transfer rate regardless of the print medium. The main functions of the ink transfer adjuvant will be described below.

1) Provision of Surface Tack

The ink transfer rate is affected by the difference in surface energy between the surface of the intermediate transfer body and the surface of the print medium. The higher the surface energy of the print medium is, the higher its wettability and thus its tack are. Thus, as the surface energy of the print medium is increased above the surface energy of the surface layer of the intermediate transfer body to increase the difference in surface energy between them, the wettability of the print medium to the inks is enhanced to accomplish an increased transfer rate. Accordingly, the surface energy of the print medium must be increased to raise the transfer rate.

Thus, by applying the ink transfer adjuvant to the print medium or coating the print medium with the ink transfer adjuvant before the transfer step described later, it is possible to increase the surface energy of ink adhering portions of the print medium, that is, to provide these portions with tack.

2) Improvement of Surface Smoothness

The ink transfer rate is affected by the area of the contact between the inks on the intermediate transfer body and the surface of the print medium. For print media with a rough surface such as ordinary paper, Japanese paper, woody paper, and embossed paper, convex portions of the print medium efficiently contact with the inks on the intermediate transfer body during transfer. On the other hand, concave portions have a reduced area contacting with the inks on the intermediate transfer body. The concave portions thus have a reduced transfer rate. In other words, the transfer rate decreases with increasing surface roughness. Accordingly, the contact area must be increased, that is, the surface of the print medium must be smoothed, in order to increase the transfer rate.

Thus, the ink transfer adjuvant is applied to the print medium or is coated on the print medium before the transfer step, so that the ink transfer adjuvant is collected in the concave portions of the surface of the print medium to improve the smoothness of the surface. This increases the area of contact between the inks on the intermediate transfer body and the print medium.

3) Adjustment of the Amount of Moisture in the Ink

The ink transfer rate is affected by the internal cohesive force and tack of the inks on the intermediate transfer body. The internal cohesive force of the inks is enhanced by evaporation of moisture caused by the moisture removal facilitating device or the like. However, the excessive evaporation of moisture reduces the surface energy of the inks and thus their tack on the print medium. Accordingly, before transfer, an appropriate amount of moisture must be provided to the ink from which moisture has been evaporated, in order to increase the transfer rate.

Thus, by applying the ink transfer adjuvant to the print medium or coating the print medium with the ink transfer adjuvant before the transfer step, it is possible to provide an appropriate amount of moisture to the ink adhering portions of the print medium to recover the tack of the surface of the inks before transfer and contact. Specifically, in FIG. 1, the amount of the ink transfer adjuvant is such that the inks from which moisture has been evaporated by the moisture removal facilitating device 6 and/or heating roller 7 have a sufficient tack at the nip portion between the intermediate transfer body 1 and the pressurizing roller 11.

4) Provision of Different Types of Print Media with Uniform Surface Properties

The ink transfer rate is affected by transfer conditions such as a transfer pressure which varies depending on the surface properties of the print medium (the properties of the surface of the print medium such as ink absorptivity and a coefficient of friction). To accommodate a great variety of print media, it is possible to optimize the transfer conditions such as the pressure in accordance with the surface properties of the print medium so as to make the transfer rate and the image grade consistent with each other. However, in this case, it is difficult to control the transfer conditions for each type of transfer media. Accordingly, the transfer conditions must be set at predetermined values. In this case, a high transfer rate can be accomplished with print media having optimum surface properties for the set transfer conditions. Further, the transferred image has a high grade. However, only a low transfer rate can be accomplished with print media having less optimum surface properties for the set transfer conditions. Further, the transferred image has a low grade. Consequently, to make the transfer rate and image grade consistent with each other for a great variety of print media, it is necessary to provide uniform surface properties for the ink adhering portions of even print media having different surface properties.

Thus, the ink transfer adjuvant is applied to the print medium or is coated on the print medium before the transfer step, so that the ink adhering portions of the print medium are coated with the ink transfer adjuvant. This makes the surface properties of the ink adhering portions the same as those of the transfer adjuvant. Then, by executing transfer under the transfer conditions optimum for the uniform surface properties, it is possible to make the transfer rate and the image grade consistent with each other.

The applying means and form of the transfer adjuvant applying device 9 are not particularly limited. However, if the transfer adjuvant is applied to the entire surface of the print medium, a roll coater or a spray coater is suitably used. Alternatively, if the transfer adjuvant is selectively applied to the print medium, a print head is suitably used which ejects the ink transfer adjuvant using the ink jet system. In this case, since the transfer adjuvant can be selectively applied to the print medium, the application can preferably be accomplished in accordance with the image to be created.

If a print head (print head for the transfer adjuvant) is used as the transfer adjuvant applying device, the ink transfer adjuvant is applied to the print medium in accordance with an image signal sent to the ink jet printing section 5. Further, if the ink jet printing section 5 has different print heads for the respective colors, the print head for the transfer adjuvant applies the ink transfer adjuvant to the print medium in accordance with the logical OR of image signals sent to the print heads for the respective colors. Accordingly, during transfer, the ink transfer adjuvant is not applied to parts of the print medium 10 which correspond to parts of the intermediate transfer body 1 to which the inks do not adhere. On the other hand, the ink transfer adjuvant is applied to parts of the print medium 10 which correspond to parts of the intermediate transfer body 1 to which the inks adhere.

The components of the ink transfer adjuvant are not limited as long as the adjuvant can provide at least one of the above four functions. However, the components are desirably transparent so as not to prevent the reproduction of the colors of the inks. For example, the simplest system is water or a liquid such as any of the water-soluble organic solvents described above as ink materials. This system mainly provides the function 3). A more preferable system is a treatment liquid containing any of the water-soluble resins described above as ink materials or a resin emulsion, and a thickener such as gelatin, water-soluble cellulose, or sugars. The physical properties such as the viscosity, surface tension, and density are adjusted in accordance with the applying means. Treatments such as thermal transfer ribbon as well as the liquid treatment allow for the surface smoothing function. Accordingly, the transfer rate can be improved.

3. Step (c)

The step (c) transfers the ink image formed on the intermediate transfer body 1 to the print medium 10, which is typically a cut sheet but may be in the form of continuous paper such as roll paper or fan fold paper.

In the step (c), the print medium 10 is brought by the pressurizing roller 11 into contact with an image forming surface of the intermediate transfer body 1 to receive the inks. On this occasion, the pressurizing roller 11 presses the print medium 10 relative to the intermediate transfer body 1 to accomplish a transfer. According to the present invention, the ink transfer adjuvant on the print medium allows the inks to be received at a high transfer rate.

However, if the time from the formation of an ink image in the step (a) to the transfer in the step (c) is excessively short, the amount of moisture in the ink may not decrease through natural evaporation to a value that leads to an appropriate transfer rate. In view of this, the moisture removal facilitating device 6 is placed between the site of ink image formation and the site of transfer as shown in FIG. 1 in order to facilitate removal of moisture from the inks.

Likewise, when the time from the application of the ink transfer adjuvant in the step (b) to the transfer in the step (c) is short, the ink transfer adjuvant may not reach a functional stage. In view of this, appropriate setting means (not shown) is desirably placed after the transfer adjuvant applying means 9 so as to set the ink transfer adjuvant at the functional stage.

Effective means for facilitating removal of moisture is, for example, air blown on an ink image forming surface or heating of this surface, besides the moisture removal facilitating device 6. Alternatively, it is effective to bring the heating roller 7 into contact with the back surface of the hollow intermediate transfer body or to heat the pressurizing roller 11, as shown in FIG. 1.

Moreover, the fixing roller 12 pressurizes the print medium on which the image has been formed via the intermediate transfer body. The surface of the print medium is thus smoothed. Further, heating by the fixing roller 11 enables the print matter to immediately become robust.

In the apparatus shown in FIG. 1, the intermediate transfer body from which the ink image has been delivered is washed by the cleaning unit 13, placed at the next stage, to provide for the next image, as described above. The washing means is desirably washing or wiping carried out by showering the intermediate transfer body, direct washing in which the intermediate transfer body is brought into contact with a water surface, wiping in which the surface of the intermediate transfer body is brought into contact with a wetted Morton roller, or the like. Of course, those means may be used together.

Moreover, if required, the surface of the intermediate transfer body may be effectively dried by for example, abutting a dry Morton roller against the intermediate transfer body or blowing air on the intermediate transfer body, after washing.

Each step or implementing means has been described in detail. In short, a technical characteristic of the present invention is that the ink image formed on the intermediate transfer body is transferred to the print medium at a high transfer rate using a process of forming an ink image on the intermediate transfer body and a process of applying the ink transfer adjuvant to the surface of the print medium, which receives the ink image, to increase the surface energy (adhesiveness) of the print medium. The high transfer rate makes it possible to reduce the amount of ink applied to the intermediate transfer body.

The five effects described below are produced by the reduction in the amount of ink applied which reduction results from the high transfer rate.

(A) Reduction in Bleeding and Beading

Both bleeding and beading are caused by contact between ink droplets. Accordingly, opportunities to bring ink droplets into contact with each other can be lessened by reducing the amount of ink applied to the intermediate transfer body.

(B) Reduction in the Amount of Moisture Volatilized

The internal cohesive force of the inks must be enhanced to increase transfer efficiency. Since the inks for ink jet printing generally contain a large amount of moisture, the internal cohesive force of the inks can be enhanced by removing this moisture from the inks on the intermediate transfer body. In this case, the smaller the amount of ink per unit area on the intermediate transfer body, the more quickly and easily the moisture can be removed.

(C) Reduction in Dot Gain During Transfer

The larger the amount of ink on the intermediate transfer body, the larger the diameter of dots because the dots are crushed owing to the pressure exerted during transfer. The increase in diameter may reduce resolution. However, this can be prevented by reducing the amount of ink.

(D) Reduction in Load During Cleaning

The smaller the amount of ink remaining on the intermediate transfer body after transfer, the more easily cleaning can be carried out.

(E) Improvement of Ink Use Efficiency

The ink use efficiency can be enhanced to reduce running costs.

The intermediate transfer body is used according to the present invention in order to remove moisture contained in the inks on the intermediate transfer body to improve the internal cohesive force of the inks. This makes it possible to form a high-quality image even on print media that do not absorb the inks well.

Further, the ink transfer adjuvant is applied to the print medium in order to increase the surface energy of the surface of the print medium, while smoothing the surface of the print medium. This allows the print medium to receive the inks better during transfer. The improved ink receiving capability enables ink images to be transferred, at a high transfer rate, to a great variety of print media including those having rough surfaces or those which do not absorb the inks well. This enables a high-quality image to be formed.

As described above, according to the present embodiment, an image is formed by applying the image fixing component to the surface on the intermediate transfer body of which has been modified and then applying the inks to the area applied the image fixing component. This makes it possible to form an ink image without beading or bleeding. The ink image is then transferred to a print medium to which the ink transfer adjuvant has been applied in order to increase the transfer rate. As a result, the ink image on the intermediate transfer body can be transferred to the print medium at a high transfer rate. Therefore, a high-quality image can be formed, without beading or bleeding, on a great variety of print media including those having rough surfaces or those which do not absorb the inks well.

Further, every time an image has been formed, the cleaning unit is used to wash the surface of the intermediate transfer body. Consequently, different images can be outputted so as to have a high quality, by combining the intermediate transfer body that can be sufficiently cleaned with the ink jet printing apparatus, which serves as digital image printing means.

Moreover, the apparatus has a simple configuration and can be easily cleaned after an image has been formed on the intermediate transfer body and after the image has been transferred from the intermediate transfer means. A small number of copies of print matter can be outputted so as to have a high quality and a reduced cost.

If the ink jet printing system is used to form an image directly on a print medium that does not absorb the inks well, the inks, having a high fluidity, run on the print medium to cause a phenomenon such as beading or bleeding. It is thus difficult to form a high-quality image.

On the other hand, when an image is formed by applying the image fixing component to the surface on the intermediate transfer body of which has been modified and then applying the inks to the area applied the image fixing component, the ink image does not undergo beading or bleeding. Further evaporation of moisture results in an ink image with an increased internal cohesive force. By transferring the ink image to the print medium, it is possible to form a high-quality image even on a print medium that does not absorb the inks well, while preventing beading or bleeding caused by a high internal cohesive force.

However, even if an ink image with a high internal cohesive force is formed, a low transfer rate prevents the image from having a desired density after transfer. As a result, a high-quality image cannot be obtained. In this case, when the amount of ink applied is increased in an attempt to obtain the desired density in the image after transfer, various problems may occur such as beading or bleeding caused by an increase in the amount of ink in the ink image on the intermediate transfer body, an increased load on cleaning of the intermediate transfer body, and an increase in running costs resulting from an increase in the amount of ink applied. A decrease in transfer rate is caused by the relationship between the surface energy of the surface of the intermediate transfer body and the surface energy of the print medium, the surface smoothness of the print medium, or the surface properties of the print medium. These effects depend on the type of the print medium, so that it is difficult to accomplish a high transfer rate for a great variety of print media. Indeed, according to the present invention or the present embodiment, to solve this problem, the ink transfer adjuvant is applied to the print medium before a transfer step. This makes it possible to increase the transfer rate regardless of the type of the print medium. By thus increasing the transfer rate, it is possible to reduce the amount of ink applied and to transfer a high-quality image formed on the intermediate transfer body to a great variety of print media. Therefore, the high-quality image can be formed even on the print medium.

SPECIFIC EXAMPLES

Now, the present invention will be specifically described taking several examples by way of example. In the following description, the term "parts (pts)" or "%" means a weight basis unless otherwise specified.

Example 1

The image printing system according to the present invention will be described below step by step.

(a) Formation of an Ink Image on the Intermediate Transfer Body

In the present example, as an intermediate transfer body, a drum was used which was made of aluminum and to which commercially available NBR having a rubber hardness of 80° and a thickness of 0.2 mm was glued. An ink jet printing apparatus (a nozzle density of 600 dpi, an ejection amount of 4 pl, and a driving frequency of 5 kHz) and an ink having a composition shown below was used to form a mirrored image of a character on the intermediate transfer body.

| | |
|---|---|
| CI. food black 2: | 2.5 parts |
| Glycerin: | 5 parts |
| Diethylene glycol: | 7 parts |
| Surface active agent: (acetylenol EH manufactured by Kawaken Fine Chemicals Co., Ltd.) | 1 part |
| Ion-exchanged water: | 84.5 parts |

(b) Application of the Ink Transfer Adjuvant to the Print Medium

On the other hand, an ultrasonic spray coating device was used to coat 2.5 ml/m$^2$ of pure water all over the surface of a print medium (commercially available PPC paper).

(c) Transfer of an Ink Image

The surface of the intermediate transfer body was brought into contact with the surface of the print medium under pressure to transfer the character image on the intermediate transfer body to the print medium. In this case, the ink transfer rate was almost 100%, and the print matter had a density high enough to provide a good visibility.

Example 2

(a) Formation of an Ink Image on the Intermediate Transfer Body

In the present example, a drum was used which was made of aluminum and on which silicone rubber (KE30 manufactured by Shin-Etsu Chemical Co., Ltd.) having a rubber hardness of 60° was coated to a thickness of 0.5 mm. Then, a roll coater was used to coat a fluorine-containing surface active agent (Surfron S-141 manufactured by SEIMI CHEMICAL Co., Ltd.) on the surface of the intermediate transfer body.

Then, the roll coater was used to coat a 5 wt % water solution of polymer flocculant (C577S manufactured by Mitsui Sitech Co., Ltd.).

Then, an ink jet printing apparatus (a nozzle density of 1,200 dpi, an ejection amount of 4 pl, and a driving frequency of 8 kHz) was used to form a mirrored color image. Inks were used which had compositions shown below.

| Dyes shown below | |
|---|---|
| Black: | CI. food black 2 |
| Cyan: | CI. direct blue 199 |

-continued

| Dyes shown below | |
|---|---|
| Magenta: | CI. acid red 289 |
| Yellow: | CI. acid yellow 23 |
| Glycerin: | 10 parts |
| Diethylene glycol: | 5 parts |
| Surface active agent (acetylenol EH manufactured by Kawaken Fine Chemicals Co., Ltd): | 1 part |
| Ion-exchanged water | |

On the other hand, a transfer adjuvant was coated all over the surface of a print medium (NPI coat paper manufactured by NIPPON PAPER) using a roll coater controlled the amount of coating by an anilox roller with a 200 screen.

| | |
|---|---|
| Water-soluble resin: (PVA-105 manufactured by Kurare Co., Ltd.) | 4 parts |
| Ion-exchanged water: | 96 parts |

(c) Transfer of an Ink Image

The surface of the intermediate transfer body was brought into contact with the surface of the print medium under pressure to transfer the color image on the intermediate transfer body to the print medium. In this case, the ink transfer rate was almost 100%, and the print matter had a high density and a high grade. A Morton roller used as a cleaning roll was found to be almost free from contaminants.

Example 3

(a) Formation of an Ink Image on the Intermediate Transfer Body

In the present example, a drum was used which was made of aluminum and on which silicone rubber (KE12 manufactured by Shin-Etsu Chemical Co., Ltd.) having a rubber hardness of 40° was coated to a thickness of 0.5 mm. First, an atmospheric-pressure plasma irradiation apparatus (ST-7000 manufactured by KEYENCE CORPORATION) was used to modify the surface of the intermediate transfer body under conditions shown below.

| | |
|---|---|
| Irradiation distance: | 5 mm |
| Plasma mode: | High |
| Treatment speed: | 100 mm/sec |

Then, a roll coater was used to coat a treatment liquid composed of a 10 wt % water solution of calcium chloride and dihydrate to which 0.5% of fluorine-containing surface active agent (Surfron S-141 manufactured by SEIMI CHEMICAL Co., Ltd.) was added. Subsequently, an ink jet printing apparatus (a nozzle density of 1,200 dpi, an ejection amount of 4 pl, and a driving frequency of 12 kHz) and four color inks were used to form a mirrored photograph image on an intermediate transfer body on which the treatment liquid was coated. The inks used had compositions shown below.

| | |
|---|---|
| Dyes shown below: | 3 parts |
| Black: | Carbon black (MCF88 |

-continued

| | |
|---|---|
| | manufactured by MITSUBISHI CHEMICAL CORPORATION) |
| Cyan: | Pigment blue 15 |
| Magenta: | Pigment red 7 |
| Yellow: | Pigment yellow 74 |
| Styrene-acrylic acid-ethyl acrylate copolymer (acid value: 240, weighted mean molecular weight: 5000): | 1 part |
| Glycerin: | 10 parts |
| Ethylene glycol: | 5 parts |
| Surface active agent (acetylenol EH manufactured by Kawaken Fine Chemicals Co., Ltd): | 1 part |
| Ion-exchanged water | |

(b) Application of the Ink Transfer Adjuvant to the Print Medium

On the other hand, an ink jet printing apparatus (a nozzle density of 1,200 dpi, an ejection amount of 4 pl, and a driving frequency of 6 kHz) was used to apply a transfer adjuvant only to the ink colored portions of a print medium (NPI coat paper manufactured by NIPPON PAPER) at a density of 25%.

| | |
|---|---|
| Water-soluble resin: Styrene-acrylic acid-ethyl acrylate copolymer (acid value: 180, weighted mean molecular weight: 4500) | 2 parts |
| Ion-exchanged water: | 98 parts |

(c) Transfer of an Ink Image

The surface of the intermediate transfer body was brought into contact with the surface of the print medium under pressure to transfer the color image on the intermediate transfer body to the print medium. In this case, the ink transfer rate was almost 100%, and the print matter had a high density and a high grade. Even when a cleaning unit was removed, this image forming system provided print matter without affecting its print quality.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2003-391484 filed Nov. 20, 2003, which is hereby incorporated by reference herein.

What is claimed is:

1. An image forming method comprising the steps of:

applying, to an intermediate transfer body having a surface on which a hydrophilic treatment is executed, a liquid for coagulating a component contained in an ink;

forming an image by ejecting the ink onto the intermediate transfer body to which the liquid has been applied;

applying, to a print medium, a material for increasing the rate of ink transfer from the intermediate transfer body to the print medium; and transferring the image of ink formed on the intermediate transfer body to the print medium to which the material has been applied, wherein the material for increasing the rate of ink transfer includes a water-soluble resin.

2. The image forming method according to claim 1, wherein the surface of the intermediate transfer body includes at least one of a fluorine compound or a silicone compound.

3. The image forming method according to claim 1, wherein the liquid includes metal ions.

4. The image forming method according to claim 1, wherein said hydrophilic treatment is at least one of a treatment for irradiating the surface of the intermediate transfer body with energy and a treatment for applying a liquid that improves wettability of the surface of the intermediate transfer body.

5. The image forming method according to claim 1, wherein the ink includes fine particle dispersions.

6. The image forming method according to claim 1, wherein the material includes a water-soluble resin or an emulsion.

7. The image forming method according to claim 1, wherein said hydrophilic treatment is a plasma treatment.

8. An image forming method comprising the steps of:

applying, to an intermediate transfer body having a surface on which a plasma treatment for making the surface hydrophilic is executed, a first liquid for coagulating a component contained in an ink;

forming an image by applying the ink onto the intermediate transfer body to which the first liquid has been applied;

applying, to a print medium, a second liquid for increasing the rate of the image to be transferred from the intermediate transfer body to the print medium; and transferring the image formed on the intermediate transfer body to the print medium to which the second liquid has been applied, wherein the second liquid for increasing the rate of the image to be transferred includes a water-soluble resin.

9. An image forming apparatus comprising:

applying means for applying, to an intermediate transfer body, a liquid for coagulating a component contained in an ink;

image forming means for forming an image by ejecting the ink onto the intermediate transfer body to which the liquid has been applied;

applying means for applying, to a print medium, a material for increasing the rate of ink transfer from the intermediate transfer body to the print medium; and a transfer portion for transfeffing the image formed on the intermediate transfer body to the print medium to which the material has been applied, wherein the material for increasing the rate of ink transfer includes a water-soluble resin.

10. An image forming method comprising the steps of:

applying, to an intermediate transfer body, a liquid for coagulating a component contained in an ink;

forming an image by ejecting the ink onto the intermediate transfer body to which the liquid has been applied;

applying, to a print medium, a material for increasing the rate of ink transfer from the intermediate transfer body to the print medium; and transferring the image formed on the intermediate transfer body to the print medium to which the material has been applied, wherein the material for increasing the rate of ink transfer includes a water-soluble resin.

11. An image forming method comprising the steps of:

applying, to an intermediate transfer body, a first liquid for coagulating a component contained in an ink;

forming an image by applying the ink onto the intermediate transfer body to which the first liquid has been applied;

applying, to a print medium, a second liquid for increasing the rate of the image to be transferred from the intermediate transfer body to the print medium; and transferring the image formed on the intermediate transfer body to the print medium to which the second liquid has been applied, wherein the second liquid for increasing the rate of the image to be transferred includes a water-soluble resin.

* * * * *